US006196352B1

(12) United States Patent
Goodchild

(10) Patent No.: US 6,196,352 B1
(45) Date of Patent: Mar. 6, 2001

(54) SOUND ATTENUATING RELOCATABLE PARTITION WALL PANEL

(75) Inventor: Jim Thompson Goodchild, Calgary (CA)

(73) Assignee: SMED International Inc., Calgary (CA)

( * ) Notice: Subject to any disclaimer, the term of this patent is extended or adjusted under 35 U.S.C. 154(b) by 0 days.

(21) Appl. No.: 09/332,157

(22) Filed: Jun. 14, 1999

(51) Int. Cl.[7] ..... E04B 1/82; E04B 2/02
(52) U.S. Cl. ..... 181/290; 181/287; 181/286
(58) Field of Search ..... 181/290, 287, 181/286, 284, 294

(56) References Cited

U.S. PATENT DOCUMENTS

| | | | | |
|---|---|---|---|---|
| 3,462,899 | | 8/1969 | Sherman | 52/309 |
| 3,822,764 | | 7/1974 | Val | 181/33 |
| 3,853,689 | * | 12/1974 | Morrone | 161/182 |
| 4,057,123 | | 11/1977 | Erickson | 181/286 |
| 4,106,588 | | 8/1978 | Moore et al. | 181/284 |
| 4,621,709 | * | 11/1986 | Naslund | 181/284 |
| 4,802,321 | * | 2/1989 | Menchetti | 52/484 |
| 4,924,969 | * | 5/1990 | L'Heureux | 181/290 |
| 5,135,073 | | 8/1992 | Nelson | 181/290 |
| 5,202,174 | * | 4/1993 | Capaul | 428/138 |
| 5,424,497 | * | 6/1995 | Dias et al. | 181/290 |
| 5,502,931 | * | 4/1996 | Munir | 52/144 |
| 5,744,763 | * | 4/1998 | Iwasa et al. | 181/286 |
| 5,753,871 | * | 5/1998 | Kahara et al. | 181/290 |

OTHER PUBLICATIONS

Warnock, A.C.C and J.D. Quirt, "Airborne Sound Insulation," Handbook of Acoustical Measurements and Noise Control, Harris, ed., 3rd edition, 1991.
Warnock and Wolfgang Fasold, "Sound Insulation: Airborne and Impact," Encyclopedia of Acoustics, vol. 3, 1997.

* cited by examiner

*Primary Examiner*—Robert E. Nappi
*Assistant Examiner*—Edgardo San Martin
(74) *Attorney, Agent, or Firm*—Gowling, Lafleur, Henderson, LLP

(57) ABSTRACT

A sound attenuating relocatable partition wall panel. A substantially rigid first skin is secured, in a spaced apart relationship to a substantially rigid second skin generally opposite thereto. The first and second skins have different respective critical frequencies at which a coincidence dip occurs in their respective sound transmission loss characteristics.

5 Claims, 5 Drawing Sheets

SOUND ATTENUATING RELOCATABLE PARTITION WALL PANEL

FIELD OF THE INVENTION

This invention relates generally to relocatable partition wall panels and more particularly to the sound attenuation characteristics of such panels.

BACKGROUND OF THE INVENTION

Moveable walls economically provide flexibility to accommodate rapidly changing business environments by enabling the owners of space to rapidly reconfigure the space to accommodate changes in the business being conducted therein. Moveable walls find use in diverse market segments including health care delivery, education and retail space. In all of these segments, acoustical privacy is a concern. For example, in the delivery of health care a reasonable degree of confidentiality is expected. In a business environment acoustical privacy is necessary both to assure confidentiality and to provide a working environment relatively free from distraction.

Associated with the need to provide acoustical privacy and flexibility is the requirement to do so at a reasonable cost. Furthermore any structure must be made from materials which satisfy any regulatory authorities having jurisdiction over the space including electrical, building and fire inspection officials.

The satisfaction of regulatory authorities makes it desirable to incorporate construction materials which are in common use and with which the officials are therefore familiar. Accordingly, while it may be desirable from a cost perspective to use certain readily available and inexpensive sheet materials for constructing relocatable wall panels, such materials may prove undesirable if the relevant authorities having jurisdiction are unfamiliar with them and thus find them difficult to evaluate and accept for use.

As gypsum wallboard (also known as plasterboard, drywall and gypboard) is well accepted for fixed wall construction it is also highly desirable as a face material for relocatable wall construction. Gypsum wallboard is also desirable because of its being familiar to the construction trades which are quite familiar with its application and repair. Other materials which although suitable for wall construction, such as steel, are less desirable as they are associated with specialized industries not typically associated with construction. Also, the materials used to repair gypsum wallboard are readily available and non-toxic. The materials used to repair or work with other skin materials may be much more difficult to work with and may be deemed toxic or at least objectionable to the occupants of the space.

Gypsum wallboard is desirable for the manufacture of unitized (ie; moveable or relocatable) wall panels due to its ready availability, easy workability and low cost. Steel and other materials, while also candidates, tend to be expensive, more difficult to obtain if manufacturing is situated far from the source, and higher in cost.

Most sheet materials, and gypsum wallboard is no exception, experience an acoustical phenomenon referred to as a "coincidence dip". The coincidence dip occurs at a critical frequency at which the wavelength of free bending waves in a panel of sheet material coincides with the wavelength of sound in air. The coincidence dip is a reduction in average Transmission Loss (ie; more sound is transmitted) at frequencies just below the critical frequency to an octave or more above. The critical frequency depends on a material's stiffness and thickness. The frequency diminishes with an increase in stiffness or thickness.

Unfortunately the coincidence dip of most common wall construction materials, including gypsum wallboard occurs in the middle of the frequency spectrum of most importance to providing speech privacy. For ½ inch (approximately 12.7 mm) gypsum wallboard, the coincidence dip is centered around 3150 Hz.

The human ear does not hear all sounds equally. It is less sensitive to low frequencies and increasingly sensitive as frequencies rise. This contributes significantly to intelligibility. Vowel sounds, which carry relatively less meaning, are generally sounded at frequencies up to 1000 Hz.

Consonants in contrast are generally sounded at significantly higher frequencies, from 1500 Hz and up. Consonants contribute more to the intelligibility of speech than vowels. Consonants for example permit discernment between such words as "cat", "bat" and "hat". Removal of consonant sounds from speech is one manner to render speech unintelligible. Accordingly, a partition system in which higher frequency speech sounds are not well transmitted contributes greatly to privacy.

It is an object of the present invention to provide a sound attenuating relocatable partition wall panel having less of a coincidence dip than conventional panels.

It is a further object of the present invention to provide such a panel which is economical and which may incorporate common wall construction materials such as gypsum wallboard.

SUMMARY OF THE INVENTION

A sound attenuating relocatable partition wall having a frame with generally parallel top, bottom and side members defining opposed, generally rectangular first and second faces. A substantially rigid first skin is secured to the frame to cover the first face and a substantially rigid second skin is secured to the frame to cover the second face. The first and second skins have different respective critical frequencies at which a coincidence dip occurs in their respective sound transmission loss characteristics.

In one embodiment, the first and second skins are of substantially identical materials having different respective thicknesses.

In another embodiment of the present invention, the first and second skins are of similar material and thickness, but made from materials having different respective stiffnesses.

In yet another embodiment, the first and second skins differ both in thickness and stiffness.

The first and second skins may be made of gypsum wallboard.

A sound deadening material such as glass-fiber may fill an enclosed space defined between the first and second skins and the frame.

DESCRIPTION OF THE DRAWINGS

Preferred embodiments of the present invention are described below with reference to the accompanying drawings in which.

DESCRIPTION OF PREFERRED EMBODIMENTS

Figure 1:
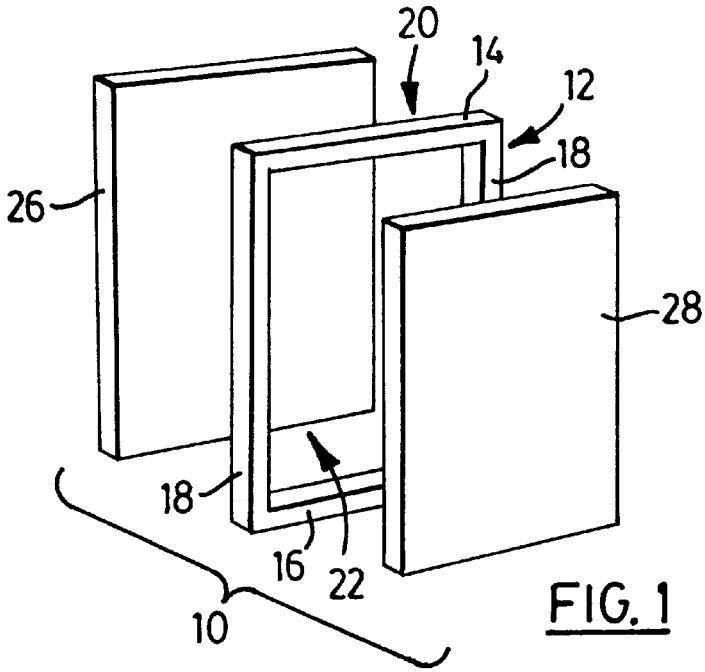
FIG. 1 is an exploded perspective view illustrating a sound attenuating relocatable partition wall panel according to the present invention.

The various embodiments of the present invention described below comprise similar structural elements which differ only in dimension or physical properties. Accordingly, to avoid confusion, structural elements having the same name are identified in the illustrations with like reference numerals.

A sound attenuating relocatable partition wall panel ("a panel") is generally indicated by reference 10 in the accompanying illustrations. The panel may include a generally rectangular frame 12 made up of generally parallel top and bottom members, 14 and 16 respectively, and generally parallel side members 18. The frame presents opposed, generally rectangular first and second faces 20 and 22 respectively.

A generally rectangular, substantially rigid first skin 26 is secured to said frame 12 to cover said first face 20. A generally rectangular, substantially rigid second skin 28 is secured to said frame 12 to cover said second face 22.

Although a frame 12 is illustrated in the drawings, it will be appreciated by one skilled in relocatable partition wall panels that in some cases a frame 12 is not entirely necessary. Some sheet materials used in such structures may be joined in a spaced apart relationship without a frame 12. For example, if steel or steel honeycomb materials are being utilized, these may be directly joined by having corresponding edges inwardly turned and joined. with further reinforcement being added at the top and bottom edges.

It will also be appreciated that although a generally rectangular panel 10 is illustrated, other shapes, such as trapezoidal would be possible. It is however expected that for most installations a Generally rectangular shape will provide the simplest installation. Basically the panels 10 should be capable of extending and closely fitting between a floor, a ceiling and adjacent panels.

Figure 2:
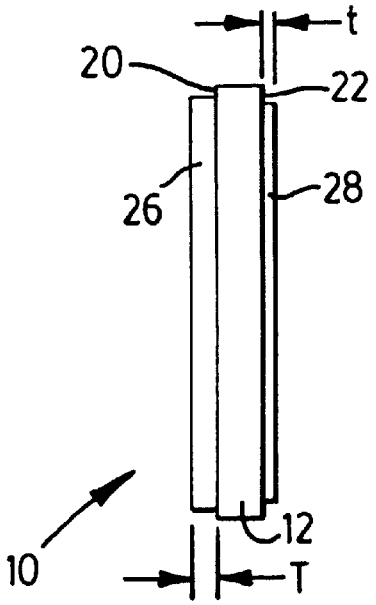
FIG. 2 is an end elevation illustrating one embodiment of a sound attenuating relocatable partition wall according to the present invention.

In the embodiment illustrated in FIG. 2, the first skin 26 and second skin 28 are sheets of gypsum wallboard of similar density and stiffness, however the first skin 26 has a thickness T greater than a thickness t of the second skin 28. Accordingly the coincidence dip of the two sheets will occur at different frequencies as the coincidence dip is related to thickness. This gives better sound attenuation than would be possible if the coincidence dip of each panel were to occur at the same frequency.

Figure 3:
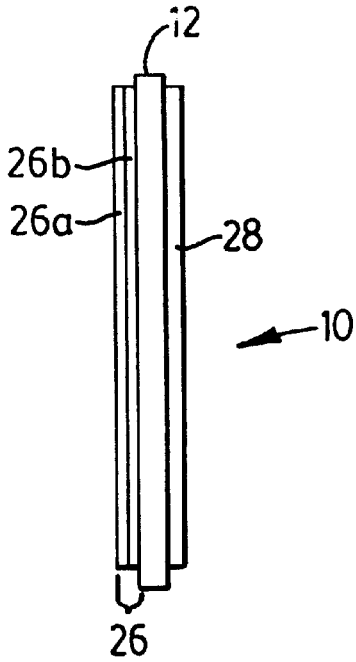
FIG. 3 is an end elevation illustrating an alternate embodiment of a sound attenuating relocatable partition wall according to the present invention.

In the embodiment illustrated in FIG. 3, the first skin 26 is made up of two thin sheets 26*a* and 26*b* of gypsum wallboard. The second skin 28 is a single sheet of gypsum wallboard which is thicker than the sheets 26*a* and 26*b*. As each of the two thinner sheets 26*a* and 26*b* would, because of their thickness, have a different critical frequency than the single thicker sheet forming the second skin 28, improved sound attenuation is obtained. An advantage to the FIG. 3 embodiment is that the total thickness of the first skin 26 may be made the same as the total thickness of the second skin 28.

Figure 4:
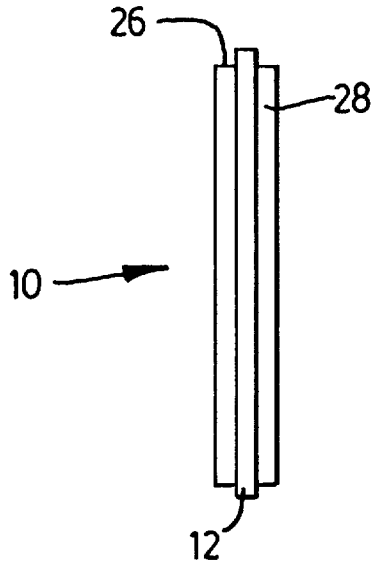
FIG. 4 is an end elevation illustrating yet another alternate embodiment of a sound attenuating relocatable partition wall panel according to the present invention.

FIG. 4 illustrates an embodiment in which the first skin 26 and second skin 28 are of similar thickness but have different respective stiffnesses. For example, the first skin 26 may be of ½ inch (12.7 mm) thick conventional gypsum wallboard and the second skin 28 may be of ½ inch (12.7 mm) thick "sag-resistant" gypsum wallboard normally intended for use on ceilings which is engineered with a higher shear modulus cone to increase its stiffness to that of standard gypsum wallboard of ⅝ inch (approximately 15.9 mm) thickness. The different stiffnesses gives rise to respectively different critical frequencies.

Figure 5:
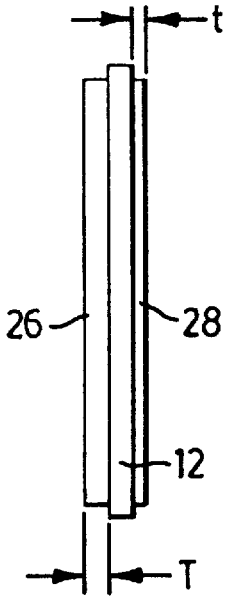
FIG. 5 is an end elevation illustrating a further alternative embodiment of a sound attenuating relocatable partition wall panel according to the present invention.

FIG. 5 illustrates an embodiment in which the first skin 26 and second skin 28 are both of gypsum wallboard but differ in both thickness and stiffness. Of course it is necessary to choose the thicknesses and stiffnesses of the sheets to separate rather than narrow the critical frequencies.

Figure 6:
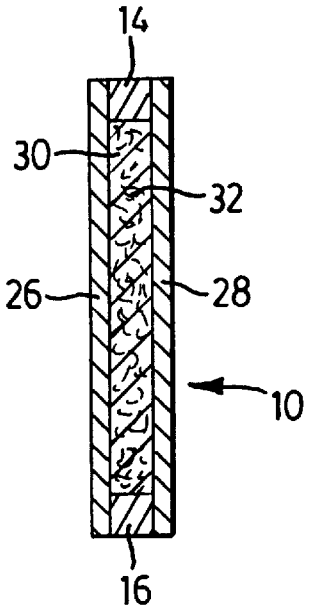
FIG. 6 is a representative vertical section through a sound attenuating relocatable partition wall panel according to the present invention.

FIG. 6 illustrates a sectional view through the panel 10. The frame (of which the top member 14 and bottom member 16 are visible in FIG. 6) in conjunction with the first skin 26 and second skin 28 define an enclosed space 30 therebetween. The enclosed space 30 in any of the above embodiments may be filled with a sound absorbing (sound deadening) material 32 to further improve sound attenuation of the panel 10. The sound deadening or absorbing material 32 may be glass-fiber insulation.

The invention is further illustrated by the following examples:

EXAMPLE 1

Figure 7:
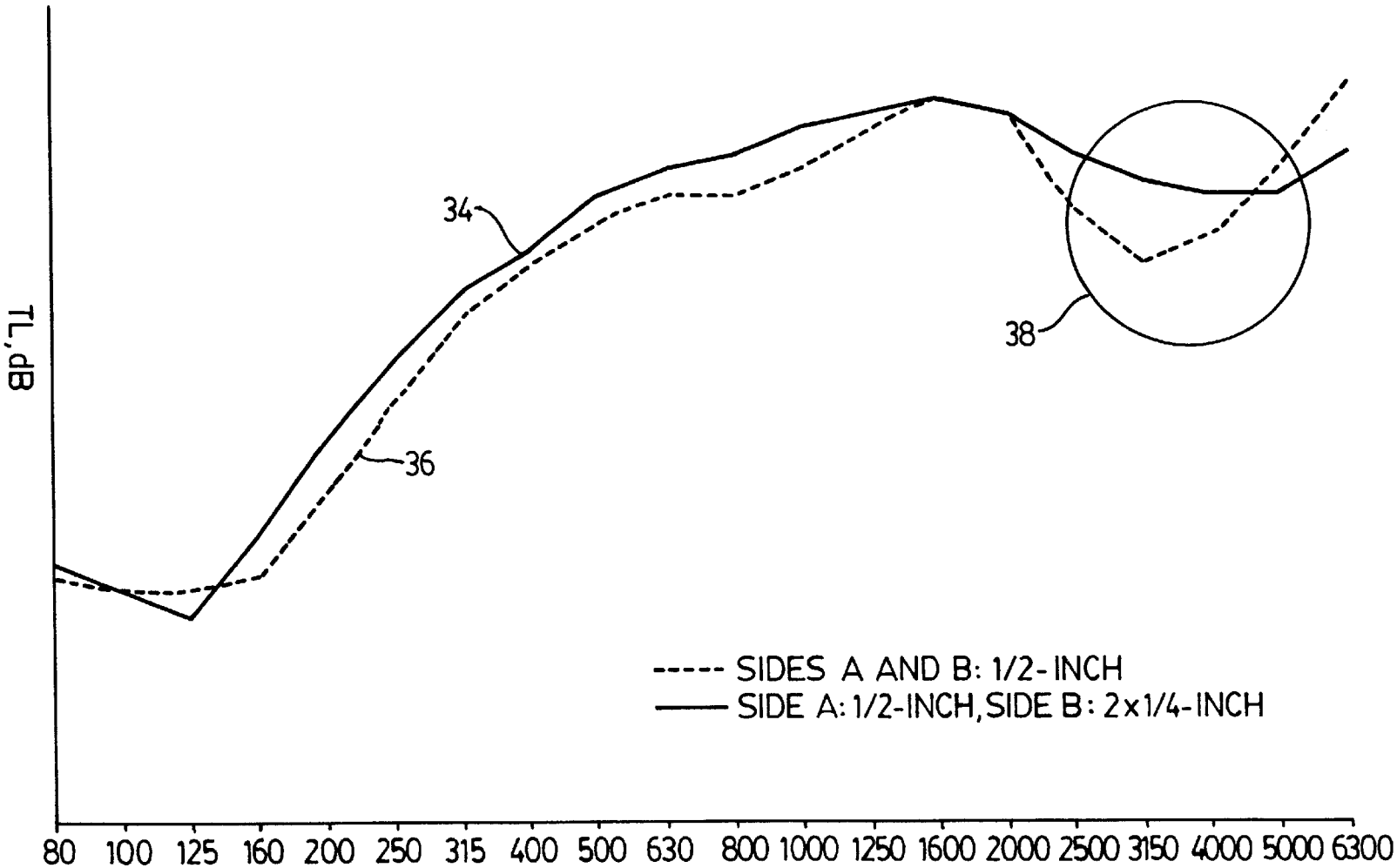
FIG. 7 is a graph illustrating frequency in Hz v. transmission loss ("TL") in dB for a test panel according to FIG. 3.

A first test panel was prepared according to the FIG. 3 embodiment utilizing two ¼ inch (approximately 6.9 mm) sheets of gypsum wallboard for the first skin 26 and one sheet of ½ inch (approximately 12.7 mm) gypsum wallboard for the second skin 28 with 2 lb/ft$^3$ (approximately 32 kg/m$^3$) insulation therebetween. FIG. 7 is a graph illustrating frequency in Hz v. Transmission Loss ("TL") in dB. A solid line 34 indicates the first test panel. A dashed line 36 is the curve for a reference panel of similar construction but having a ½ inch (approximately 12.7 mm) thick gypsum wallboard sheet as the first and second skins, 26 and 28 respectively. A circled area indicated by reference 38 shows the diminished coincidence dip of the first test panel.

EXAMPLE 2

Figure 8:
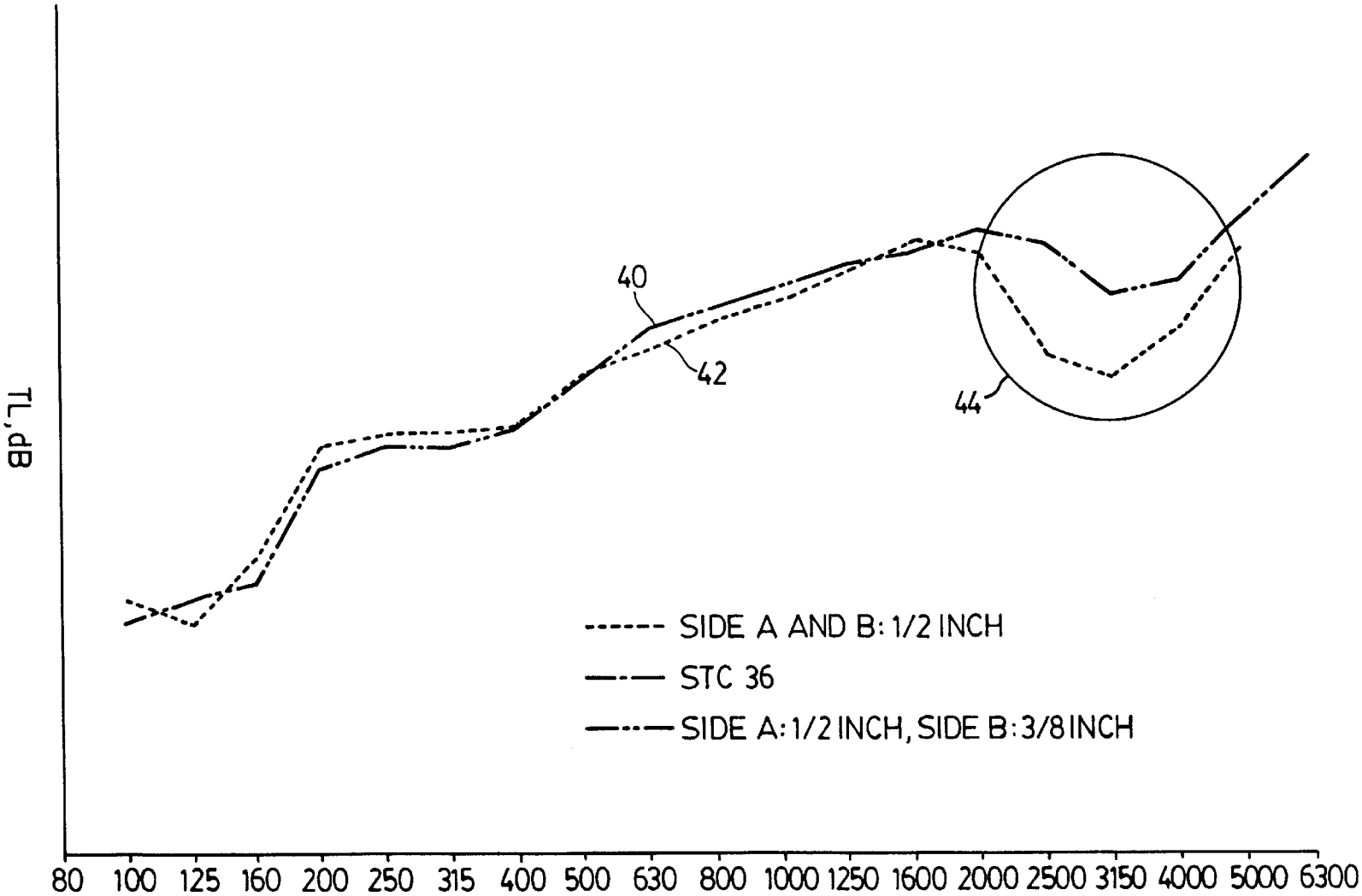
FIG. 8 is a graph frequency in Hz v. transmission loss ("TL") in dB for a test panel according to FIG. 2; and, FIG. 9 is a graph illustrating frequency in Hz v. transmission loss ("TL") in dB for a test panel according to FIG. 4.

A second test panel was prepared according to the embodiment illustrated in FIG. 2 in which the first skin 26 was of ½ inch (approximately 12.7 mm) thick gypsum wallboard, the second skin 28 was of ⅜ inch (approximately 9.5 mm) gypsum wallboard with ¾ lb/ft$^3$ (approximately 12 kg/m$^3$) insulation therebetween. FIG. 8 is a graph of frequency (Hz) v. Transmission Loss ("TL") (dB) in which a line 40 represents the second test panel and a line 42 represents the curve for a reference panel of similar construction but having a ½ inch (approximately 12.7 mm) thick gypsum wallboard sheet as the first and second skins, 26 and

28 respectively. A circle indicated by reference 44 shows the diminished coincidence dip of the second test panel.

EXAMPLE 3

Figure 9:
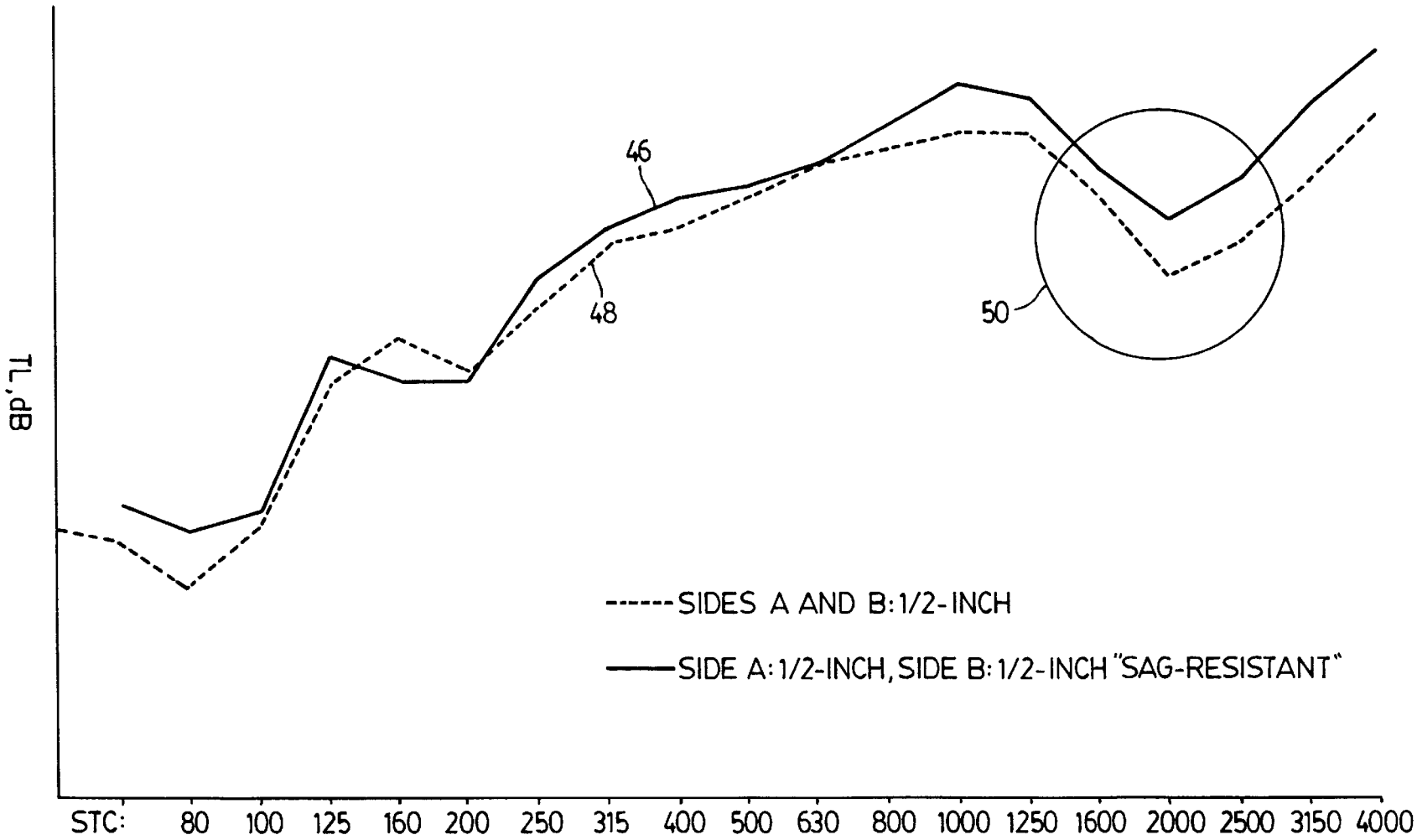

A third test panel was prepared according to the embodiment described in FIG. 4 using a sheet of ½ inch (12.7 mm) thick conventional gypsum wallboard for the first skin 26 and a sheet of ½ inch (12.7 mm) thick "sag-resistant" gypsum wallboard for the second skin 28 with ¾ lb/ft$^3$ (approximately 12 kg/m$^3$) insulation therebetween. FIG. 9 is a graph of frequency (Hz) v. Transmission Loss ("TL") (dB) in which a solid line 46 represents the third test panel and a dashed line 48 represents the curve for a reference panel of similar construction but having a ½ inch (approximately 12.7 mm) thick gypsum wallboard sheet as the first and second skins (26 and 28) respectively. A circle indicated by reference 50 shows the diminished coincidence dip of the third test panel.

The above embodiments are intended in an illustrative rather than a restrictive sense. Variations may be apparent to appropriately skilled persons without departing from the spirit and scope of the invention as defined by the claims below.

I claim:

1. A sound attenuating relocatable partition wall panel comprising:

opposed, substantially rigid first and second skins each of a single sheet of sheet wall construction material secured in a spaced apart relationship wherein said first and second skins have different respective critical frequencies at which a coincidence dip occurs in their respective sound transmission loss characteristics;

said first and second skins being of similar thickness; and, said first and second skins being made from materials having different respective stiffnesses.

2. A sound attenuating relocatable partition wall panel as claimed in claim 1 wherein:

said first skin is of conventional gypsum wallboard; and, said second skin is a sag-resistant gypsum wallboard having a higher shear modulus core than said first skin.

3. A sound attenuating relocatable partition wall panel as claimed in claim 2 wherein:

said first and second skins are secured to opposite sides of a frame;

said frame and said first and second skins define an enclosed space therebetween; and, said enclosed space is filled with a sound deadening material.

4. A sound attenuating relocatable partition wall panel as claimed in claim 3 wherein said sound deadening material is glass-fiber insulation.

5. A sound attenuating relocatable partition wall panel comprising substantially rigid first and second skins secured in a spaced apart relationship wherein said first and second skins have different respective critical frequencies at which a coincidence dip occurs in their respective sound transmission loss characteristics;

said first skin has a different thickness than said second skin;

said first and second skins are secured to opposite sides of a frame;

said frame and said first and second skins define an enclosed space therebetween;

said enclosed space is filled with a sound absorbing material;

said sound absorbing material is glass-fiber insulation;

said first skin consists of ½" (approximately 12.7 mm) thick gypsum wallboard;

said second skin consists of ⅜" (approximately 905 mm) thick gypsum wallboard; and, wherein said second skin has a higher density than said first skin whereby said first and second skins are of similar mass.

* * * * *